United States Patent [19]

Midkiff et al.

[11] Patent Number: 4,929,480

[45] Date of Patent: May 29, 1990

[54] ABSORBENT STRUCTURE FOR ABSORBING FOOD PRODUCT LIQUIDS

[75] Inventors: David G. Midkiff, Alpharetta; Carl G. Rippl, Woodstock; Nancy D. Twyman, Norcross; Joseph D. Wahlquist, Woodstock, all of Ga.

[73] Assignee: Kimberly-Clark Corporation, Neenah, Wis.

[21] Appl. No.: 75,382

[22] Filed: Jul. 20, 1987

[51] Int. Cl.[5] ..... B32B 15/16

[52] U.S. Cl. ..... 428/35.6; 428/36.2; 428/74; 428/283; 428/284

[58] Field of Search ..... 428/913, 284, 283, 35.6, 428/36.2, 74

[56] References Cited

U.S. PATENT DOCUMENTS

| | | | |
|---|---|---|---|
| 3,156,402 | 11/1964 | Dupuis | 229/30 |
| 3,575,287 | 4/1971 | Graveley . | |
| 3,577,258 | 5/1971 | Sincavage | 117/62 |
| 3,580,413 | 5/1971 | Quackenbush . | |
| 3,637,405 | 1/1971 | Mendelson et al. . | |
| 3,940,062 | 2/1976 | Rainey | 239/56 |
| 4,100,324 | 7/1978 | Anderson et al. | 428/288 |
| 4,105,033 | 8/1978 | Chatterjee et al. | 428/913 |
| 4,124,116 | 11/1978 | McCabe | 206/204 |
| 4,234,647 | 11/1980 | Murphy et al. . | |
| 4,237,171 | 12/1980 | Laage | 426/127 |
| 4,256,770 | 3/1981 | Rainey . | |
| 4,275,811 | 6/1981 | Miller | 206/204 |
| 4,321,997 | 3/1982 | Miller | 206/204 |
| 4,382,507 | 5/1983 | Miller | 206/204 |
| 4,392,861 | 7/1983 | Butterworth et al. | 428/913 |
| 4,407,897 | 10/1983 | Farrell et al. | 428/516 |
| 4,410,578 | 10/1983 | Miller | 428/117 |
| 4,425,410 | 1/1984 | Farrell et al. | 428/516 |
| 4,464,443 | 8/1984 | Farrell et al. | 428/688 |
| 4,551,377 | 11/1985 | Elves et al. | 428/137 |
| 4,576,278 | 3/1986 | Laiewski | 206/204 |
| 4,604,313 | 8/1986 | McFarland et al. | 428/284 |
| 4,619,361 | 10/1986 | Thomas, Jr. . | |
| 4,699,823 | 10/1987 | Kellenberger et al. | 428/913 |
| 4,702,377 | 10/1987 | Grone | 206/557 |
| 4,720,410 | 1/1988 | Lundquist et al. | 428/136 |

FOREIGN PATENT DOCUMENTS 0068530 5/1982 European Pat. Off. .

*Primary Examiner*—Marion C. McCamish

[57] ABSTRACT

An absorbent structure for collecting and retaining exuded fluids from food products such as meat and poultry is disclosed herein. The structure has a fluid permeable top sheet and a fluid impermeable bottom sheet with an absorbent core of pulp coform material located therebetween. In a preferred embodiment the periphery of the top and bottom sheets are sealed to form a pouch and the pulp coform material is stratified into a first top layer and a second bottom layer. Superabsorbents such as carboxymethylcellulose may be added to the coform material to aid in fluid retention. In the preferred embodiment the superabsorbent is located in the bottom layer of pulp coform while the top layer of the pulp coform is substantially devoid of the superabsorbent.

5 Claims, 2 Drawing Sheets

ABSORBENT STRUCTURE FOR ABSORBING FOOD PRODUCT LIQUIDS

BACKGROUND OF THE INVENTION

The present invention relates to a new and improved structure for absorbing liquids from food products. More particularly, the invention relates to an absorbent pad for meat and poultry products.

Over the years, the methods of marketing and selling food products have changed dramatically, especially with perishable products such as meat, poultry, fish, and vegetables. A long-standing tradition has been to display such products in bulk form, thereby allowing the purchaser to individually select the item or items to be purchased. This was particularly true with respect to meat and poultry products which were most commonly sold by a butcher from display cases. Today, many of these products arrive at the grocery store prepackaged. Such packaging, especially with respect to meat and poultry, involves the use of a semi-rigid tray to contain the product and a plastic overwrap to seal the product within the tray to maintain the freshness of the contents for a finite period.

Such products as meat and poultry naturally contain liquids/juices and occasionally added water which with time will drain from the product. When such products were sold at butcher counters, these liquids would drain to the bottom of the display case. However, when the same products are packaged within relatively air- and liquid-tight packages, these liquids end up collecting within the tray and subsequently leaking during transportation and handling. Market analysis has revealed that the consumer finds such liquid-containing packages to be less than desirable. Consequently, many such packages today employ an absorbent material in the bottom of the tray to absorb the liquids as they are released from the food product.

One commonly used material for such purposes is tissue and/or wood pulp fluff which is usually encased within a material such as plastic film or tissue paper. Many other designs have also been developed to be used generally with food packaging. Other designs have been specifically developed to act in concert with a particular package design.

A liquid absorbing and concealing device which includes both a liquid absorbing bag and a tray is disclosed in DuPuis, U.S. Pat. No. 3,156,402. The liquid absorbing bag is composed of two superposed sheets of material which are sealed by heat welding or adhesive around their marginal edges. The sheets may be formed from material such as waxed paper, cellophane, polyethylene, or other thermoplastic or thermosetting plastic materials. Each of the sheets contain a series of openings or holes to permit fluid to enter the bag from either the top or the bottom by the use of gravity and capillary action.

In a reverse application, U.S. Pat. No. 3,940,062 to Rainey discloses a moisture pad for use in hydration of consumable vegetables which have been sealed in plastic and refrigerated. The pad includes a water containing reservoir element which is encased in a sheath of moisture-proof film with openings for escape of the moisture from the reservoir. The pad consists of a sponge or other absorbent or porous pad which is saturated with water to act as the water reservoir. The hydrated sponge is then located within a flexible water-impervious envelope which is sealed or otherwise closed about its periphery. The envelope is then provided with openings to allow for the escape of moisture from the absorbent sponge within.

Another liquid-absorbing device, in this case a liquid-absorbing sectional pack, is disclosed in U.S. Pat. No. 4,124,116 to McCabe, Jr. The pack is formed from upper and lower contiguous filter sheets which are bonded to each other at the outermost contiguous edges thereof to form an enclosure. The enclosure itself is divided into a plurality of sectional compartments which are isolated from each other by dissolving barrier sheets which consist essentially of a water-soluble carboxymethylcellulose compound. Each of the sectional compartments contain a predetermined quantity of absorbent granules and the barrier sheets function to dissolve when the granules have absorbed a pre-determined amount of moisture so as to provide for increased space in which to contain the moist granules.

A receptacle for moisture-exuding food products is described in U.S. Pat. No. 4,321,997 and U.S. Pat. No. 4,410,578 both to Miller. A receptacle is provided for containing and displaying food products which tend to exude juices or liquids which comprises a supporting member such as a tray or bag, and an absorbent pad associated therewith. The absorbent pad comprises a mat of liquid-absorbent material such a wood fluff, an upper liquid-impermeable plastic sheet overlying the absorbent mat, and a bottom plastic sheet underlying the absorbent mat. At least one of the sheets is perforated, and rigid spacer means is disposed between the two sheets to maintain their separation under a compressive load such that the ability of the pad to absorb liquids is unimpaired when the pad is subjected to compressive loading from the food product resting thereon or the like. In this construction, it is preferred that only the bottom sheet be perforated such that when a food product is positioned upon the upper sheet of the absorbent pad, any exuded liquids will flow around the pad and enter the mat by capillary action through the perforated openings in the bottom sheet so as to hold the liquids out of contact with the food product to minimize contamination of the product and maintain its appearance and improve its shelf life.

A receptacle and absorbent pad for containing and displaying food products which tend to exude juices or liquids are disclosed in U.S. Pat. Nos. 4,275,811 and 4,382,507 both to Miller. The pad comprises a mat of liquid absorbent material, an upper liquid impermeable sheet overlying the absorbent mat and a perforated bottom sheet underlying the absorbent mat. When a food product is positioned upon the upper sheet of the absorbent pad, the exuded liquids flow around the pad and enter the mat by capillary action through the perforated openings of the bottom sheet and the liquids are held out of contact with the food product by the impermeable upper sheet. In preferred embodiments the absorbent mat is composed of a relatively thick layer of wood fluff and a relatively thin layer of tissue-like paper wadding which may be interconnected by embossing. In addition, various additives may be added to increase liquid absorbency.

Another absorbent pad for use with packaged meats is disclosed in U.S. Pat. No. 4,451,377 to Elves, et al. The absorbent pad is made from a nonwoven fabric material such as viscose rayon, superabsorbent viscose rayon, or polyvinyl alcohol. One side of the pad has a layer of binder material to provide a surface with reduced absorbency as compared to the remainder of the pad with the remainder of the pad being free of binder. In addition, the pad may have apertures formed therein to allow fluid to pass through the binder layer and into the remainder of the nonwoven material. The fibers of the nonwoven material are entangled by needle punching or preferably by the use of high-pressure water jets. The web is then dried and after drying a binder is applied to the one surface of the pad.

A food tray for supporting, containing, and displaying food products which tend to exude or purge juices or liquids is disclosed in U.S. Pat. No. 4,576,278 to Laiewski. The tray has a false bottom which leads to an exudate reservoir. The false bottom is made from a perforated liquid-impermeable thermoplastic film such as polyethylene.

The primary function of each of the above-described devices is to absorb the fluids which are exuded from packaged food products. Leaky packages are among the foremost complaints received by food store operators. Their use in such products, therefore, adds to the cost of the overall product. As a result, a major driving force in the development of such products is to provide an absorbent structure which provides ample absorbency while employing cost-efficient components. Furthermore, such designs should yield products with good wet strength, resilience and fluid retention characteristics. Products such as tissue tend to break apart when wetted. Such materials also readily release their absorbed fluids when placed under a compressive load. This most notably happens when packages are stacked one upon the other.

It is therefore, an object of the present invention to provide an absorbent structure for collecting and retaining fluids released from foods which provides good containment of exuded fluids and which does not readily release such fluids when under compression or break apart when wet. It is an additional object of the present invention to provide an absorbent structure which while having the capability of absorbing fluids does not aggressively extract the fluids from the food product. These and other objects and advantages of the present invention will become more readily apparent upon a further review of the following specification, drawings and claims.

SUMMARY OF THE INVENTION

The present invention relates to a new and improved structure for absorbing liquids from food products and in particular meat and poultry. The absorbent structure comprises a top sheet of fluid permeable material such as a nonwoven spunbonded or meltblown material. Alternatively the top sheet may be constructed of a fluid impermeable material such as plastic with at least one perforation therein to allow fluid passage therethrough. The bottom sheet is constructed of a fluid impermeable material. An absorbent inner core of pulp coform material is positioned between and joined to the top and bottom sheets. The pulp coform material contains between 50 and 90 percent by weight wood pulp fluff (based upon the weight of the absorbent core) and between 10 and 50 percent by weight synthetic fibers. Included within the absorbent core there may be placed superabsorbent material such as carboxymethylcellulose.

In a preferred embodiment of the present invention the top and bottom sheets are sealed about their periphery to create a fluid collection pouch with an inner chamber to house a stratified absorbent core. The stratified absorbent core includes a first layer of pulp coform material adjacent the top of the pouch and a second layer adjacent the bottom of the pouch. The first layer is substantially devoid of superabsorbent material and the second layer contains a superabsorbent such as carboxymethylcellulose in a weight percent add on of from 5 to 100 percent based upon the total weight of the absorbent inner core.

DESCRIPTION OF THE PREFERRED EMBODIMENT

The present invention relates to an absorbent pad for collecting and retaining fluids from foods, most notably meat and poultry. Much of the meat and poultry sold in stores today is prepacked in styrofoam trays and wrapped with transparent polymeric film. It has now become common practice to place an absorbent material within the package to absorb the fluids that are released from the food product. Due to space and cooling constraints, these packages are often stacked one upon the other, thereby multiplying the compressive load upon each of the packages, their contents and the absorbent pads. In addition, the packages when stacked are rarely in a completely horizontal plane. As a result, the juices absorbed by the pad will commonly be compressed, at least partially, back out of the pad and pool in the lowest point of the package. Consequently, there is still a high probability that the package will leak.

Figure 1:
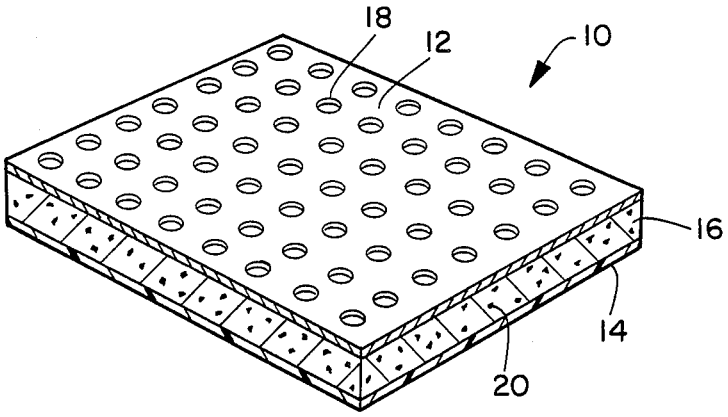
FIG. 1 is a perspective view of an absorbent structure for collecting and retaining fluids released from foods according to the present invention.

Referring to FIG. 1 there is shown an absorbent structure 10 for collecting and retaining fluids released from foods. The structure 10 has an outer cover including a fluid permeable top sheet 12 and bottom sheet 14 of fluid impermeable material such as polyethylene film. Positioned between and joined to the top and bottom layer 12 and 14 is a fluid absorbent inner core 16 which is joined to the outer layers 12 and 14 by suitable means such as adhesives or embossments. To permit the exuded fluids from the food to enter the absorbent structure 10, there is provided at least one perforation 18 in the top sheet 12 which may take the form, for example, of a hole, slit, or capillary funnel. In the embodiment shown in FIG. 1 the top sheet 12 is supplied with a plurality of perforations 18 to facilitate transfer of fluid into the absorbent core 16. Alternatively, the top sheet 12 may be formed from a fibrous nonwoven material such as a spunbond or meltblown which will allow the passage of fluids to the absorbent core 16.

The design of the absorbent core 16 of the present invention provides both good absorbency and structural integrity to resist the release of fluids when the core material 16 is placed under compression. To accomplish this, the absorbent core material 16 is comprised of a pulp coform material which is made from a mixture of wood pulp fluff and extruded thermoplastic synthetic fibers. One way to make this material is referred to as the pulp coform process which is disclosed in U.S. Pat. No. 4,100,324 to Anderson, et al, which is commonly assigned to the Kimberly-Clark Corporation and incorporated herein by reference. To provide the necessary degree of wet resilience and absorbency the pulp coform material contains between 50 and 90 percent by weight of wood pulp fluff and between 10 and 50 percent by weight of synthetic fibers based upon the total weight of the wood pulp fluff and synthetic fibers. The wood pulp acts as the absorbent while the synthetic fibers, which are disposed throughout the wood pulp, make the composite more resilient both when wet and dry. The wood pulp fluff is 100 percent softwood pulp, or softwood pulp containing up to 30 percent hardwood fiber. Softwood pulp fibers generally exhibit fiber diameters in the range of 35 microns to 45 microns and lengths of 3 mm to 5 mm. After processing into coformed structures the fiber length is reduced and averages approximately 2 mm. Hardwood fibers exhibit fiber diameters from about 14 microns to 32 microns with lengths in the range of approximately 1 mm to 2 mm. The synthetic fibers are most typically made from extrudable meltblown thermoplastic materials such as polypropylene or polyethylene fibers with an average fiber diameter of up to 10 microns and more preferably in the range of 2 to 6 microns. These fibers are discontinuous and as a result have a length generally in excess of the staple fiber wood pulp fluff material. Densities for the pulp coform material used in the present invention range from about 0.03 $g/cm^3$ to about 0.20 $g/cm^3$ with various absorbencies when tested using deionized water as the absorbing fluid. (See the absorbency graph of FIG. 4).

To further enhance the capacity of the absorbent core 16, a superabsorbent material 20 may be added to the pulp coform material of the core 16. One method of adding such material is disclosed in U.S. Pat. No. 4,604,313 which is assigned to the Kimberly-Clark Corporation and incorporated herein by reference. Any number of superabsorbents may be used with the absorbent structure 10, however, because the absorbent structure 10 is used in conjunction with food, the superabsorbent should be cleared by the United States Food and Drug Agency. One such preferred superabsorbent is carboxymethylcellulose (CMC) such as is sold by the Aqualon Company of Wilmington, Delaware under the designation A-250. The superabsorbent may be added to the pulp coform material in powder or other form either during the formation of the coform material or thereafter. The measure of the increase in fluid absorbency in the absorbent core 16 is dependent upon the amount of superabsorbent 18 added to the pulp coform material. Preferably the superabsorbent 20 is added to the absorbent core 16 in a weight percent add on of from 5 to 100 percent based upon the total weight of the absorbent core material 16.

In use, the absorbent structure 10 is placed between the food product (not shown) and the tray or other packaging material (not shown) with the perforated top sheet 12 in contact with the food product. As juices, etc., are released from the food product, they pass through the perforations 18 of the nonwoven material of the top sheet 12 and are collected and retained within the absorbent core 16. Unlike simple wood pulp fluff, the pulp coform material of the present invention is more resistant to compression when wet due to the use of the synthetic fibers. As a result, the absorbent structure 10 is less likely to release its fluids when compressed, especially if a superabsorbent 20 is being used.

Figure 2:
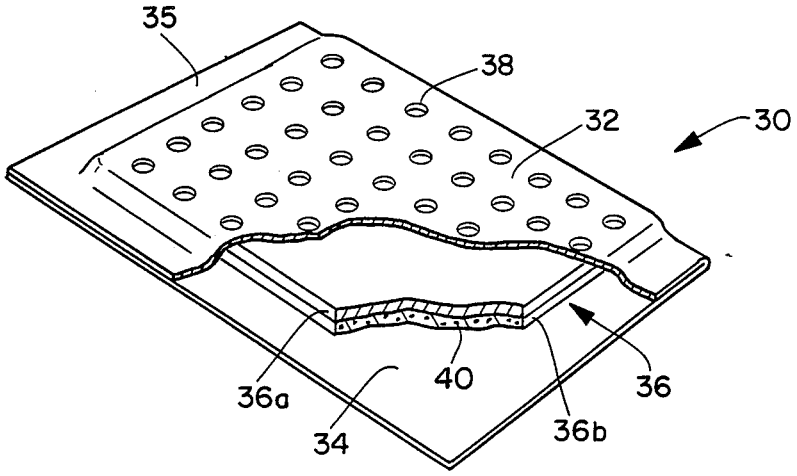
FIG. 2 is a perspective view with a partial cutaway of another absorbent structure for collecting and retaining fluids released from foods according to the present invention.
Figure 3:
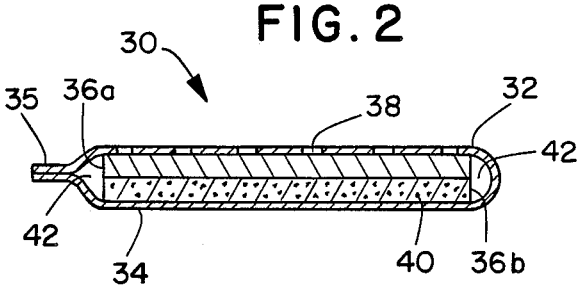
FIG. 3 is a cross-sectional view of an absorbent structure for collecting and retaining fluids released from foods according to the present invention.

A more self-contained and preferred embodiment 30 of the present invention is shown in FIGS. 2 and 3 of the drawings. As with the embodiment of FIG. 1, the absorbent structure 30 has a top sheet 32 and a bottom sheet 34 of the same materials as previously mentioned and an absorbent core 36 of pulp coform material. One or more perforations 38 are present in the top sheet 32 if it is not made from a nonwoven material and a superabsorbent 40 as previously discussed may be used within the pulp coform material.

Unlike the embodiment shown in FIG. 1, the top and bottom sheets 32 and 34 are sealed about their periphery 35 by adhesive, heat or other means. As shown in FIG. 2, the absorbent structure 30 may be made of two separate sheets 32 and 34 which are sealed about their entire periphery 35. Alternatively, as shown in cross-section in FIG. 3, the top and bottom sheets 32 and 34 may be formed from a single sheet of material which is folded over on itself, thus only requiring sealing on three sides. Also note that the absorbent structures 10 and 30 are not limited to square or rectangular shapes and may be designed in any other shape to suit the particular application.

An important additional feature of the embodiment shown in FIGS. 2 and 3 is the stratified absorbent core 36. In this embodiment the absorbent core 36 is comprised of a first layer **36*a* adjacent the top sheet 32 and a second layer 36*b* adjacent the bottom sheet 34. Both the first layer 36*a* and the second layer 36*b* are formed from the same pulp coform material as described with respect to the embodiment of FIG. 1. Again, the pulp coform material should contain between 50 and 90 percent by weight wood pulp fluff and between 10 and 50 percent by weight synthetic fibers. If desired, the layers 36*a* and 36*b*** may have the same or different ratios of wood pulp fluff and synthetic fibers.

In the embodiment of FIGS. 2 and 3, the superabsorbent 40, most preferably carboxymethylcellulose, is only present in the second layer **36*b*. As a result, it is desirable to have a higher synthetic fiber concentration in the second layer 36*b* to provide greater interstitial spacing to prevent gel blocking as the second layer 36*b* and superabsorbent 40** absorb fluids. Again the superabsorbent concentration should be from 5 to 100 percent by weight based upon the combined weight of the wood pulp fluff and synthetic fibers.

By splitting the absorbent core 36 into two layers **36*a* and 36*b* and placing the superabsorbent in the second layer 36*b*, two distinct advantages are achieved. First, the superabsorbent material 40 is located away and separated from the fluid permeable top sheet 32. As a result, there is less likelihood that the superabsorbent 40 will filter through the perforations 38 in the top sheet 32** and come in contact with the food product. Secondly, whenever a superabsorbent is used in an absorbent material, it increases the capillary action or "drawing power" of the absorbent. With food products, this can result in a premature dehydration of the food product. By distancing the superabsorbent from the food product, this drawing power is reducing while still allowing the enhanced utilization of the fluid retentive properties of the superabsorbent.

Lastly, the absorbent structure 30 of FIGS. 2 and 3 may be provided with a fluid reservoir area 42 within the absorbent structure 30 between the absorbent core 36 and the sealed periphery 35. In so doing, the absorbent structure 30 is provided with a contained fluid run-off area for temporary storage of the fluids when the structure 30 is under severe compression or when the structure 30 has received more fluid than the absorbent core 36 can hold. As a result, the absorbent structure of the present invention can more readily receive and contain fluids received from the food product stored within the food package (not shown). Furthermore, by providing a self-contained system with perforations directly in contact with the food product, there is less likelihood of pooling of fluids within the food tray and ultimate leakage from the container.

EXAMPLES

Representative absorbencies were evaluated for different basis weight pulp coform inner core materials both with and without the use of superabsorbent. Absorbencies for each of the pulp coform materials were evaluated using the following procedure:

1. A 4 inch (10.2 cm) by 6 inch (15.2 cm) sample of the pulp coform material was weighed and then immersed in a deionized water bath for 20 minutes.
2. The sample was removed from the bath by lifting with a glass rod placed in the middle of the sample so as to drape the sample over the rod.
3. The rod with the sample draped over it was then suspended to allow any free water not bound in the superabsorbent or coform material to flow from the sample for a period of one minute.
4. The sample was then placed on a balance and the wet weight was recorded.
5. The water absorbency was calculated by subtracting the dry weight from the wetted weight of the sample and plotted in FIG. 4.

EXAMPLE Ia

A pulp coform sample devoid of carboxymethylcellulose was subjected to the test procedure outlined above. The sample had a basis weight of 75 g/m$^2$ with 80 percent by weight pulp and 20 percent by weight polypropylene fiber. Sample thickness was 1.02 mm and the bulk density was 0.073 g/cm$^3$. As plotted in FIG. 4, water absorbency was 1.05 g/6.45 cm$^2$ surface area.

Figure 4:
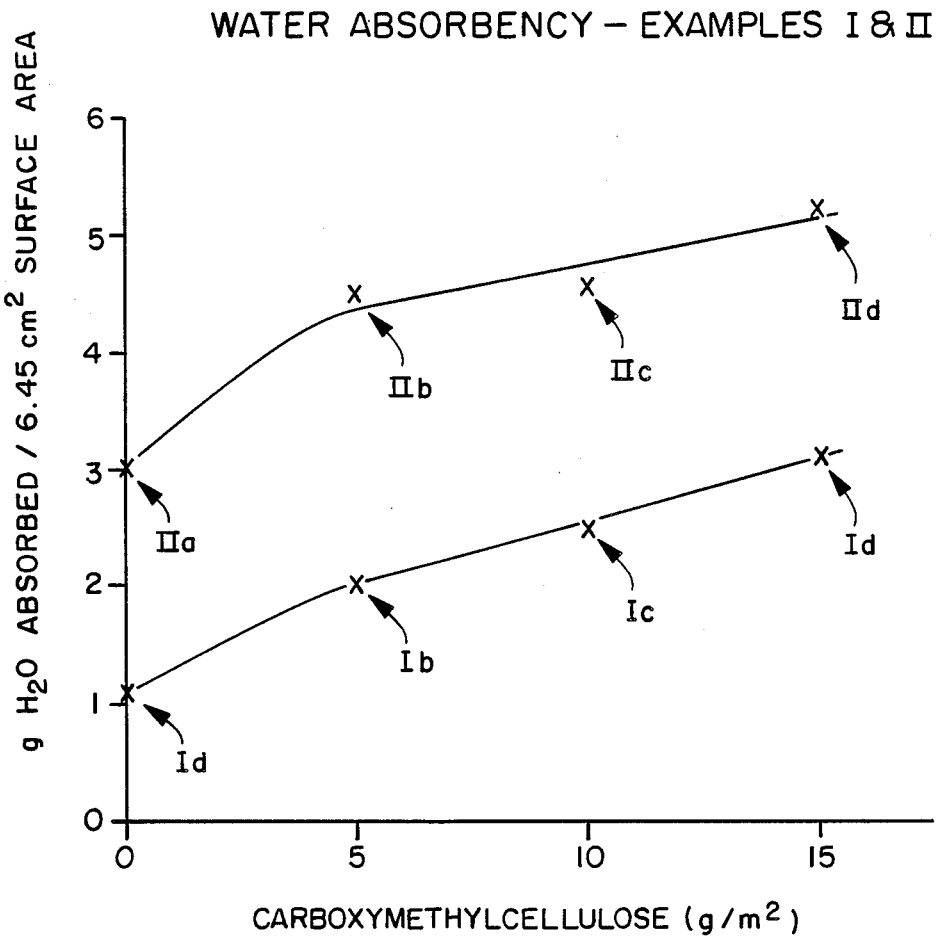
FIG. 4 is a graph showing the water absorbency of the inner core material of the present invention alone and in combination with varying amounts of superabsorbent material.

EXAMPLE Ib 5.0 g/m$^2$ of carboxymethylcellulose was added to a sample of material identical to Example Ia. Water absorbency was 1.98 g/6.45 cm$^2$ as shown in FIG. 4.

EXAMPLE Ic 10.0 g/m$^2$ of carboxymethylcellulose was added to a sample of material identical to Example Ia. Water absorbency was 2.51 g/6.45 cm$^2$ as shown in FIG. 4.

EXAMPLE Id 15.0 g/m$^2$ of carboxymethylcellulose was added to a sample of material identical to Example Ia. Water absorbency was 3.17 g/6.45 cm$^2$ as shown in FIG. 4.

EXAMPLE IIa

A pulp coform sample again devoid of carboxymethylcellulose was subjected to the test procedure outlined above. The sample had a basis weight of 200 g/m$^2$ with 80 percent by weight pulp and 20 percent by weight polypropylene fiber. Sample thickness was 4.04 mm and the bulk density was 0.050 g/cm$^3$. As plotted in FIG. 4, water absorbency was 2.93 g/6.45 cm$^2$ surface area.

EXAMPLE IIb 5.0 g/m$^2$ of carboxymethylcellulose was added to a sample of material identical to Example IIa. Water absorbency was 4.47 g/6.45 cm$^2$ as shown in FIG. 4.

EXAMPLE IIc 10.0 g/m$^2$ carboxymethylcellulose was added to a sample of material identical to Example IIa. Water absorbency was 4.54 g/6.45 cm$^2$ as shown in FIG. 4.

EXAMPLE IId 15.0 g/m$^2$ of carboxymethylcellulose was added to a sample of material identical to Example IIa. Water absorbency was 5.20 g/6.45 cm$^2$ as shown in FIG. 4.

As can be seen from the foregoing data, the absorbency of pulp coform material can be increased by the addition of a superabsorbent material. In comparing the absorbency of Example Id and IIa it can be seen that a thinner superabsorbent containing pulp coform material can be used in place of a thicker non-superabsorbent containing pulp coform material. As a result, a thinner product with equal absorbency can be achieved if so desired.

Having thus described the invention in detail, it should be appreciated that various modifications and changes can be made in the present invention without departing from the spirit and scope of the following claims.

We claim:

1. An absorbent structure for collecting and retaining fluids released from foods comprising:

a fluid permeable top sheet, a fluid impermeable bottom sheet, and an absorbent inner core of pulp conform material positioned between and joined to said top and bottom sheets, said absorbent inner core containing between 50 and 90 percent by weight wood pulp fluff and between 10 and 50 percent by weight synthetic fibers based upon the combined weight of said wood pulp fluff and said synthetic fibers, said absorbent inner core being divided into a first layer adjacent said top sheet and a second layer adjacent said bottom sheet, said second layer having a higher synthetic fiber concentration than said first layer, said first layer being substantially devoid of a superabsorbent material and said second layer containing a superabsorbent material in a weight percent add on from 5 to 100 percent based upon the combined weight of said wood pulp fluff and said synthetic fibers in said second layer.

2. The absorbent structure of claim 1 wherein said superabsorbent material is carboxymethylcellulose.

3. An absorbent structure for collecting and retaining fluids released from foods comprising:

a fluid collection pouch having a fluid permeable top sheet and a fluid impermeable bottom sheet joined by a sealed periphery and defining a chamber therein, and an absorbent inner core of pulp coform material within said chamber containing 50 to 90 percent by weight wood pulp fluff and 10 to 50 percent by weight synthetic fibers based upon the combined weight of said wood pulp fluff and said synthetic fibers, said absorbent inner core being divided into a first layer adjacent said top sheet of said pouch and a second layer adjacent said bottom sheet of said pouch, said second layer having a higher synthetic fiber concentration than said first layer, said first layer being substantially devoid of a superabsorbent material and said second layer containing a superabsorbent material in a weight percent add on of from 5 to 100 percent based upon the combined weight of said wood pulp fluff and said synthetic fibers in said second layer.

4. The absorbent structure of claim 3 wherein said superabsorbent in said second layer is carboxymethylcellulose.

5. The absorbent structure of claim 3 wherein said fluid collection pouch and said absorbent inner core define a fluid reservoir area between said absorbent inner core and said sealed periphery for additional storage of said fluids.

* * * * *